United States Patent [19]

Edwards

[11] 4,373,634

[45] Feb. 15, 1983

[54] RESILIENT NESTABLE CUP

[75] Inventor: Bryant Edwards, Clarendon Hills, Ill.

[73] Assignee: Illinois Tool Works Inc., Chicago, Ill.

[21] Appl. No.: 225,954

[22] Filed: Jan. 19, 1981

[51] Int. Cl.[3] ..... B65D 21/02

[52] U.S. Cl. ..... 206/520

[58] Field of Search ..... 206/519, 520

[56] References Cited

U.S. PATENT DOCUMENTS 3,091,360 5/1963 Edwards .

3,288,340 11/1966 Shapiro ..... 206/519

3,519,165 7/1970 Hawley ..... 206/519

FOREIGN PATENT DOCUMENTS 2403935 8/1975 Fed. Rep. of Germany ..... 206/519

*Primary Examiner*—George E. Lowrance

*Attorney, Agent, or Firm*—Thomas W. Buckman

[57] ABSTRACT

A thin walled nestable thermoplastic cup having stacking rings configured in the side walls to permit nonjamming, telescopic association of a series of like containers, the stacking rings incorporating bulbous shoulder means to enhance axial resilience in a stack of so nested cups.

5 Claims, 5 Drawing Figures

RESILIENT NESTABLE CUP

BACKGROUND OF THE INVENTION

This invention relates generally to the field of nestable, thin walled plastic containers of the disposable variety which incorporate stacking means in the sidewalls thereof to prevent jamming between adjacent telescopically arranged containers.

It is well known to incorporate a stacking ring structure in the side walls of such containers, as shown in U.S. Pat. Nos. 3,139,213 and 3,091,360 to overcome the tendency of telescopically nestable cups to jam when subjected to handling, axial impact, etc. These examples of prior art show a stacking ring with an internal shoulder and external shoulder interconnected by a back tapered support strut. Such a configuration adequately prevents jamming and provides a certain amount of resilience in the axial direction due to the back taper of the strut.

SUMMARY OF THE INVENTION

It is an object of the present invention to provide a thin walled, nestable cup with improved axial resiliency when arranged in a stack of telescoping like containers.

It is a further object of the present invention to provide a thin walled, nestable cup having a stacking ring configuration which permits the minimization of the thickness of the walls of the container while continuing to protect each container from impact damage when assembled in a telescopic stack arrangement.

These and other objects and advantages of the present invention are attained by the provision of a bulbous or blister-like protuberance on one of the co-acting shoulders in the stacking means. The bulbous or blister-like protuberance, being of a relatively large surface area, freely deflects axially upon axial shock or pressure. This, coupled with the natural resilience provided by the back taper in a stacking ring of the type described, should protect even very thin walled containers from axially directed impact damage.

It is contemplated that the basic aspects of this invention can be incorporated in a container wherein the stacking means is adjacent the bottom of the wall, as in U.S. Pat. No. 3,091,360, as well as adjacent the lip, for example, when the container is designed to accept a lid and wherein the stacking means incorporates a camming feature to facilitate the association of the lid to the container.

Other objects and advantages of the present invention will become apparent from the following description when taken in connection with the accompanying drawings.

DETAILED DESCRIPTION OF THE PREFERRED EMBODIMENTS

Figure 1:
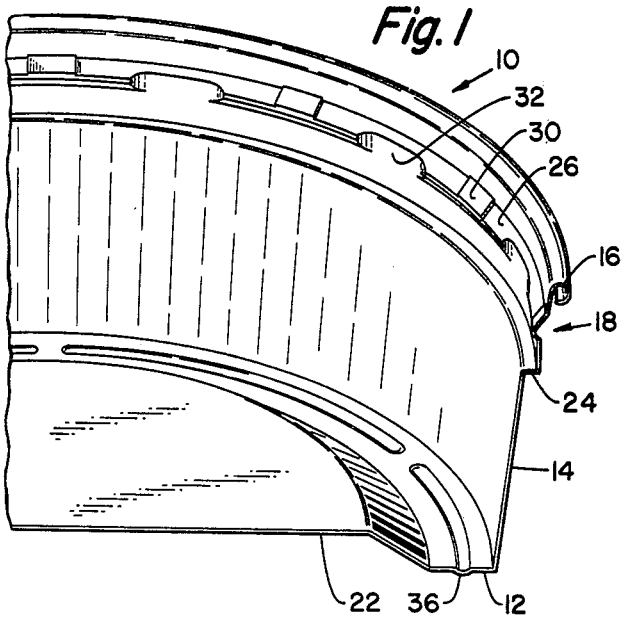
FIG. 1 is a perspective view in partial section of the inside of a first embodiment of nestable cup configured in accordance with the invention.
Figure 2:
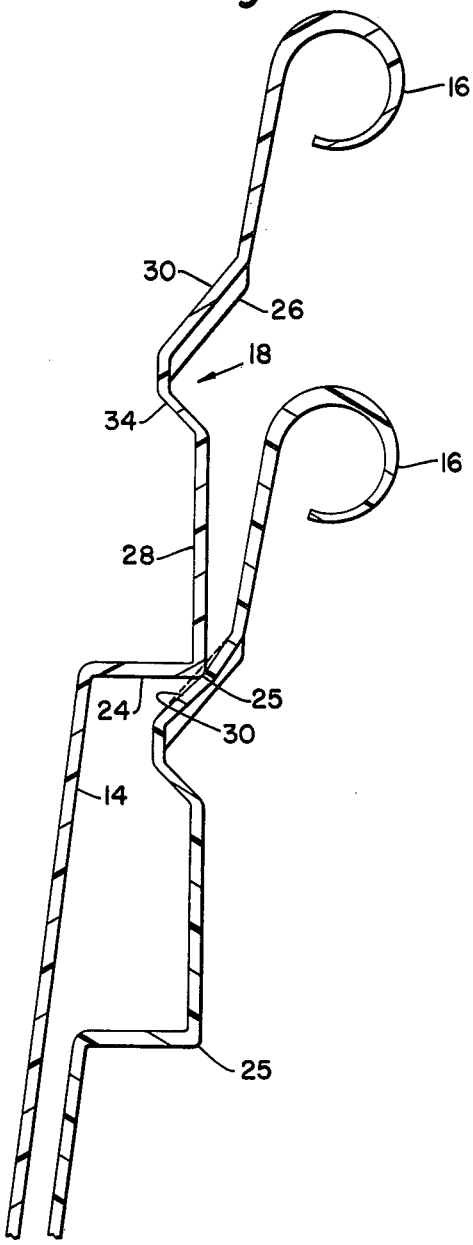
FIG. 2 is an enlarged fragmentary sectional view illustrating the stacking configuration of a plurality of cups of the FIG. 1 variety.

Referring more particularly to FIGS. 1 and 2, there will be seen a plastic molded or thermoformed cup designated generally by the numeral 10. The cup, as shown in FIGS. 1 and 2, is typically utilized as a dairy or cottage cheese container, but the invention is not necessarily restricted to such a use. Such cups or containers are typically handled for filling by nestably stacking or associating a plurality of like containers and vending or separating the lowermost container from the other containers in the stack. Such containers typically are made of plastic and preferably of high-impact polystyrene. Basically, the container includes a bottom wall 12, upwardly and outwardly tapering side walls 14 joining a thickened rim portion 16 having a predetermined axial extent for a purpose to be described later herein. Container 10 will include a stacking ring structure 18 generally typical of prior art containers of this type.

Stacking ring structure 18 will be shown to include an externally projecting shoulder means 24 at the lowermost extremity of the stacking ring structure and an internally projecting shoulder means 26 at the upper extremity of the stacking ring structure. A slightly back tapered support strut 28 integrally connects the two shoulders.

In the embodiment shown in FIG. 1, the external shoulder 24 is essentially a peripherally extending, radial ledge extending in a plane generally perpendicular to the axis of the container and which terminates at a juncture line 25 between the ledge 24 and the back tapered support 28. The uppermost internally projecting shoulder 26 is shown to be tapered inwardly and downwardly defining an inner diameter which is less than the outer diameter of the external shoulder means.

In operation, a series of telescopically associated containers 10 will be configured so that the external shoulder 24, and more precisely, the juncture 25, which creates a first co-acting surface, abuts a second co-acting surface on the uppermost internal shoulder 26 to prevent the containers from jamming. The predetermined axial extent of the rim 16 should be no greater than the axial extent of the stacking ring means so as to not prevent proper mating functions between first and second co-axial surfaces.

Attention is directed to the plurality of circumferentially spaced, generally bulbous or blister-like raised regions 30 superimposed over the inclined internal shoulder 26. These regions 30, forming a co-acting surface, are of sufficient surface to be relatively freely flexed downwardly when contacted by the edge 25, which is the first mentioned co-acting surface, as shown clearly in FIG. 2. This compression may result from shock or axial pressure applied to the stack and provides sufficient protection from damaging the walls or components of the cup under such shock.

Reference should also be made to the provision for interruptions 32 circumferentially spaced about the perimeter of the internal shoulder means 26. This provides for proper venting and ease of association of a lid to the container. Lids and containers of this general type are, of course, shown in U.S. Pat. No. 3,061,139, and a container of this type may be provided with an undercut means 34 to aid in the locking of the lid on the container without harming the stacking and resilient shock impact resisting feature of this invention.

Figure 3:
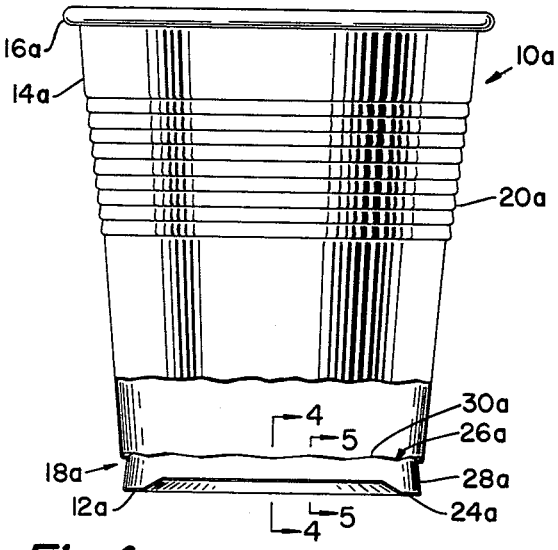
FIG. 3 is a front elevational view with the bottom region in section of an alternate form of nestable cup utilizing the invention.
Figure 4:
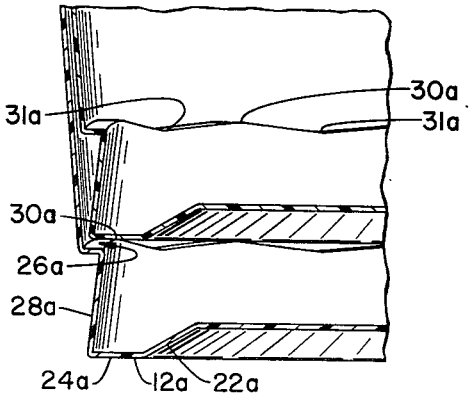
FIG. 4 is an enlarged fragmentary sectional view illustrating the stacking between cups of the FIG. 3 variety and as taken along lines 4—4 of FIG. 3 of a bottommost cup in the stack.
Figure 5:
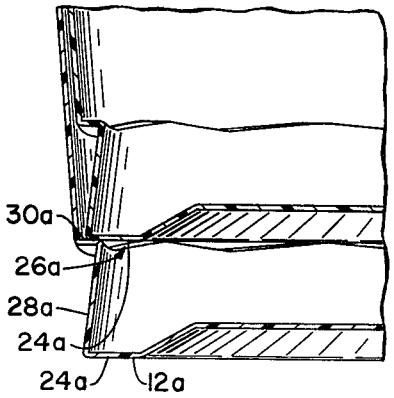
FIG. 5 is an enlarged fragmentary sectional view illustrating the stacking between cups of the FIG. 3 variety and as taken along lines 5—5 of FIG. 3 of a cup in the bottommost stacking relationship.

Turning to FIGS. 3 through 5, a further embodiment of the basic invention will be shown wherein a thermoplastic cup, thin walled in nature, is described generally by the reference numeral 10*a* and like elements throughout the various views of the drawings are intended to designate similar elements or components with the addition of the suffix "a". For example, upwardly and outwardly tapering side walls 14*a* emanate from a bottom wall 12*a* toward and merging with rim 16*a* in cup 10*a*. However, unlike the embodiment shown in FIG. 1, the embodiment shown in FIGS. 3 through 5 includes the stacking means 18*a* adjacent the bottom wall rather than adjacent the rim. It should also be noted that the outer peripheral region of the bottom wall creates the externally extending shoulder 24*a* for the stacking ring structure. The internal shoulder 26*a* is configured as a gradually undulating circumferentially extending ledge which, in effect, presents a series of bulbous or V-shaped protrusions 30*a* interconnected at lowermost surface regions 31*a*. These bulbous axial protrusions 30*a* function in a manner similar to the portions 30 in FIG. 1. The function and operation of these resilient, bulbous regions 30*a* as second surface means designed to co-act with a first surface means 24*a* is clearly shown in FIGS. 4 and 5. FIG. 4 shows a cross section of a lowermost cup in a stack of cups taken at the circumferential region of the lowermost surface regions 31*a* or the regions intermediate the bulbous regions 30*a*.

Likewise, the section shown in FIG. 5 shows the cross section taken at the circumferential region of highest point of the bulbous regions 30*a*.

Throughout this description it should be understood that the word "bulbous" is intended to cover any relatively large surface area of slight axial raised region of a shoulder having a well defined plane. For example, in FIG. 1 the well defined plane of the internal shoulder 26 is frusto-conical with a series of raised protuberances 30 formed over this plane. In the other embodiments, in FIGS. 3 through 5, the well defined plane is that on which the junction lines 31*a* lies and the generally wide angled, V-shaped bulges 30*a* are the resilient means to permit the thin walled cups to reduce the impact damage upon one another. In all embodiments, a highly resilient section is created capable of absorbing a wide range of axially directed shock forces without damage to the cups. It should also be understood that due to the thin-walled thermoplastic construction, both co-acting surfaces described herein will exhibit resilience, thus contributing to the overall effect of the invention.

Having described the invention, it is to be understood that changes can be made in the described embodiment by one skilled in the art within the spirit and broad scope of the invention as defined by the claims herein.

I claim:

1. One-piece nestable cup of thin wall plastic construction comprising a bottom wall and side wall integral therewith tapering upwardly and outwardly therefrom, the upper margin of the sidewall having thickened rim means of predetermined axial extent, said side wall having circumferential stacking ring means formed therein positioned below said upper margin and adjacent the bottom wall and having an axial extent greater than the axial extent of the thickened rim means, said stacking ring means having, at its lower extremity, circumferentially disposed externally projecting shoulder means and having, at its upper extremity, circumferentially disposed internally projecting shoulder means of smaller minimum diameter than the maximum diameter of said external shoulder means and spaced upwardly therefrom, said internal shoulder means adapted to form a shelf to co-act with the complementary external shoulder means of a like container to positively limit the extent of telescopic association of said like containers, supporting strut portion located between the internally projecting shoulder means and externally projecting shoulder means, the strut portion tapered downwardly and outwardly toward the bottom wall of the axial uppermost extremity of the strut extending inwardly of the axial lowermost extremity of the strut, one of said shoulder means presenting a co-acting first surface means extending in a plane generally perpendicular to the central axis of the cup, and the other of said shoulder means including a generally bulbous co-acting second surface means adapted to extend toward a first support of a telescopically associated like container, the bulbous second surfacing being of significant surface area relative to the surface circumferential area of the remainder of the shoulder means upon which it is formed whereby limited contact between said first and second co-acting surfaces transforms into substantial contact in the plane of the first surface means due to the resilient compression of the bulbous surface upon axial force exerted on the stack of cups, the first and second co-acting surface and strut portion creating two co-acting spring means which cooperate to overcome the effect of shock loading on a stack of nested containers.

2. The one-piece nestable cup of claim 1 wherein the second surface means are incorporated in the internal shoulder means.

3. The one-piece nestable cup of claim 1 wherein the bulbous second surface means are incorporated in an axial undulating shelf configuration providing a plurality of circumferentially spaced, generally V-shaped thin walled protuberances.

4. The one-piece nestable cup of claim 3 wherein the first surface means are generally planar outer peripherally regions of the wall.

5. One-piece nestable cup of thin wall plastic construction comprising a bottom wall and side wall integral therewith tapering upwardly and outwardly therefrom, the upper margin of the sidewall having thickened rim means of predetermined axial extent, said side wall having circumferential stacking ring means formed therein positioned below said upper margin and having an axial extent greater than the axial extent of the thickened rim means, said stacking ring means having, at its lower extremity, circumferentially disposed, externally projecting shoulder means and having, at its upper extremity, circumferentially disposed, internally projecting shoulder means of smaller minimum diameter than the maximum diameter of said external shoulder means and spaced upwardly therefrom, said internal shoulder means adapted to form an inwardly tapered shelf to co-act with the complementary external shoulder means of a like container to positively limit the extent of telescopic association of said like containers, supporting strut portion located between the internally projecting shoulder means and externally projecting shoulder means, the externally projecting shoulder means presenting a co-acting first surface means and the inwardly tapered shelf including a generally bulbous co-acting second surface means adapted to extend toward a first surface of a telescopically associated like container, the bulbous second surface being of significant surface area relative to the surface circumferential area of the remainder of the shoulder means upon which it is formed whereby limited contact between said first and second co-acting surfaces transforms into substantial contact due to the resilient compression of the bulbous surface upon axial force exerted on the stack of cups, the stacking means being adjacent the rim with the internal shoulder means extending downwardly and inwardly from the side wall and the bulbous second surface means including a plurality of circumferentially spaced, slightly raised regions interposed by circumferentially spaced venting recesses.

* * * * *